US008939556B2

(12) United States Patent
Pollard et al.

(10) Patent No.: US 8,939,556 B2
(45) Date of Patent: Jan. 27, 2015

(54) FLUID EJECTION DEVICE

(71) Applicant: Hewlett-Packard Developement Company, L.P., Houston, TX (US)

(72) Inventors: Jeffrey R. Pollard, Corvallis, WA (US); Tsuyoshi Yamashita, Corvallis, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/834,524

(22) Filed: Mar. 15, 2013

(65) Prior Publication Data

US 2013/0200175 A1 Aug. 8, 2013

Related U.S. Application Data

(63) Continuation-in-part of application No. 13/156,534, filed on Jun. 9, 2011, now abandoned.

(51) Int. Cl.
*B41J 2/16* (2006.01)
*B41J 2/14* (2006.01)

(52) U.S. Cl.
CPC ..... *B41J 2/14274* (2013.01); *B41J 2/1612* (2013.01); *B41J 2/161* (2013.01); *B41J 2/1623* (2013.01); *B41J 2/1632* (2013.01); *B41J 2/1646* (2013.01)
USPC ..... 347/70; 347/65; 347/72; 310/324

(58) Field of Classification Search
USPC ..... 347/64–75
See application file for complete search history.

(56) References Cited

U.S. PATENT DOCUMENTS

| | | | | |
|---|---|---|---|---|
| 5,376,857 | A * | 12/1994 | Takeuchi et al. | 310/328 |
| 5,856,837 | A * | 1/1999 | Kitahara et al. | 347/70 |
| 6,045,208 | A | 4/2000 | Hirahara et al. | |
| 6,347,862 | B1 * | 2/2002 | Kanno et al. | 347/68 |
| 6,457,222 | B1 * | 10/2002 | Torii et al. | 29/25.35 |
| 6,502,928 | B1 * | 1/2003 | Shimada et al. | 347/68 |
| 6,921,158 | B2 | 7/2005 | Zhang | |
| 6,949,869 | B2 * | 9/2005 | Junhua et al. | 310/328 |
| 7,019,438 | B2 * | 3/2006 | Takahashi et al. | 310/324 |
| 7,211,930 | B2 * | 5/2007 | Homma | 310/322 |
| 7,266,868 | B2 * | 9/2007 | Sugahara | 29/25.35 |
| 7,271,526 | B2 * | 9/2007 | Boecking et al. | 310/366 |
| 7,294,951 | B2 * | 11/2007 | Oouchi et al. | 310/348 |
| 7,295,224 | B2 * | 11/2007 | Busch et al. | 347/188 |
| 7,364,254 | B2 * | 4/2008 | Yamazaki et al. | 347/23 |

(Continued)

*Primary Examiner* — Matthew Luu
*Assistant Examiner* — Lily Kemathe
(74) *Attorney, Agent, or Firm* — Dicke, Billig & Czaja, PLLC; Mark A. Peterson

(57) ABSTRACT

A fluid ejection device includes a flexible membrane, an adhesive layer, a piezoelectric material layer, and first and second electrically conductive layers. The adhesive layer and the piezoelectric material layer include edge regions and central regions. A surface of the edge region of the piezoelectric material layer is coplanar with a surface of the edge region of the adhesive layer. The first electrically conductive layer is between the piezoelectric material layer and the adhesive layer such that a surface of the first electrically conductive layer is coplanar with the surface of the edge region of the piezoelectric material layer and the surface of the edge region of the adhesive layer. The second electrically conductive layer is over the surface of the edge region of the piezoelectric material layer, the surface of the edge region of the adhesive layer, the surface of the first electrically conductive layer, and the flexible membrane.

17 Claims, 9 Drawing Sheets

(56) References Cited

U.S. PATENT DOCUMENTS

| | | | | |
|---|---|---|---|---|
| 7,420,317 | B2 * | 9/2008 | Bibl et al. | 310/311 |
| 7,466,329 | B2 * | 12/2008 | Koyama et al. | 347/188 |
| 7,508,118 | B2 * | 3/2009 | Imahashi et al. | 310/334 |
| 7,526,846 | B2 * | 5/2009 | Bibl et al. | 29/25.35 |
| 7,559,631 | B2 * | 7/2009 | Shimada et al. | 347/64 |
| 7,618,116 | B2 * | 11/2009 | Hamasaki et al. | 347/35 |
| 7,739,777 | B2 * | 6/2010 | Sugahara | 29/25.35 |
| 7,851,977 | B2 * | 12/2010 | Ruile et al. | 310/334 |
| 7,854,497 | B2 * | 12/2010 | Cruz-Uribe et al. | 347/71 |
| 7,997,695 | B2 * | 8/2011 | Shimada | 347/70 |
| 7,997,696 | B2 * | 8/2011 | Shimada | 347/70 |
| 8,053,956 | B2 * | 11/2011 | Bibl et al. | 310/366 |
| 8,162,466 | B2 * | 4/2012 | Bibl et al. | 347/94 |
| 8,646,879 | B2 * | 2/2014 | Miyazawa et al. | 347/68 |
| 2009/0230088 | A1 | 9/2009 | Bibl et al. | |
| 2012/0229576 | A1 * | 9/2012 | Ohsawa | 347/68 |

* cited by examiner

FLUID EJECTION DEVICE

CROSS-REFERENCE TO RELATED APPLICATIONS

This Utility Application is a Continuation-In-Part application of U.S. application Ser. No. 13/156,534, filed Jun. 9, 2011, which is incorporated herein by reference.

BACKGROUND

An inkjet printing system may include a printhead, an ink supply that supplies liquid ink to the printhead, and an electronic controller that controls the printhead. The printhead ejects drops of ink through a plurality of nozzles or orifices toward a print medium, such as a sheet of paper, to print onto the print medium. Typically, the orifices are arranged in one or more columns or arrays such that properly sequenced ejection of ink from the orifices causes characters or other images to be printed upon the print medium as the printhead and the print medium are moved relative to each other.

One type of printhead includes a piezoelectrically actuated printhead. The piezoelectrically actuated printhead includes a substrate defining a plurality of fluid chambers, a flexible membrane supported by the substrate and over the fluid chambers, and a plurality of actuators arranged on the flexible membrane. Each actuator includes a piezoelectric material that deforms when an electrical voltage is applied to the actuator via a pair of electrodes. When the piezoelectric material deforms, a portion of the flexible membrane deflects thereby causing ejection of fluid from a fluid chamber through an orifice or nozzle. Typically, one of the electrodes for each actuator is coupled to a control signal line and the other one of the electrodes for each actuator is coupled to a common reference or ground signal line.

DETAILED DESCRIPTION

In the following detailed description, reference is made to the accompanying drawings which form a part hereof, and in which is shown by way of illustration specific examples in which the disclosure may be practiced. In this regard, directional terminology, such as "top," "bottom," "front," "back," "leading," "trailing," etc., is used with reference to the orientation of the Figure(s) being described. Because components of examples of the present disclosure can be positioned in a number of different orientations, the directional terminology is used for purposes of illustration and is in no way limiting. It is to be understood that other examples may be utilized and structural or logical changes may be made without departing from the scope of the present disclosure. The following detailed description, therefore, is not to be taken in a limiting sense, and the scope of the present disclosure is defined by the appended claims.

Figure 1:
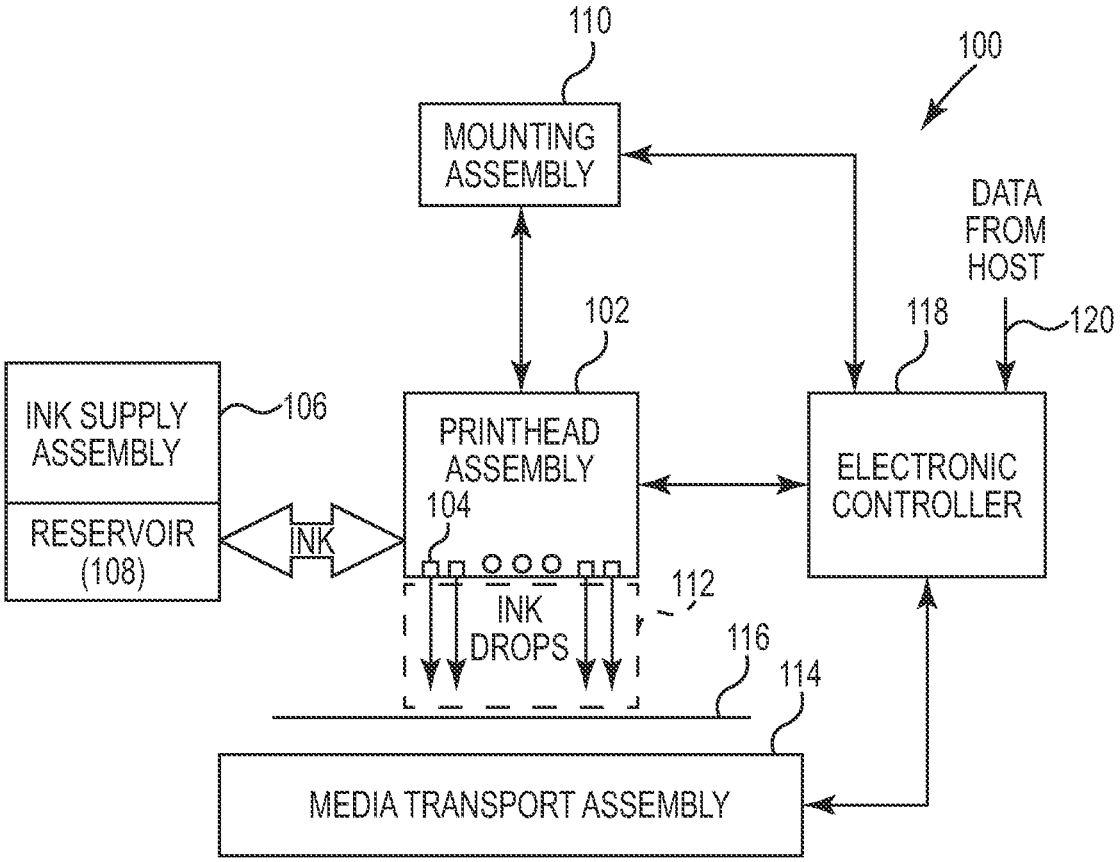
FIG. 1 is a block diagram illustrating one example of an inkjet printing system.

FIG. 1 is a block diagram illustrating one example of an inkjet printing system 100. Inkjet printing system 100 provides a fluid ejection system that includes a fluid ejection device, such as a printhead assembly 102. Inkjet printing system 100 also includes a fluid supply, such as an ink supply assembly 106, a mounting assembly 110, a media transport assembly 114, and an electronic controller 118.

Printhead assembly 102 ejects drops of ink, including one or more colored inks, through a plurality of orifices or nozzles 104. While the following disclosure refers to the ejection of ink from printhead assembly 102, in other examples other liquids, fluids, or flowable materials may be ejected from printhead assembly 102. Printhead assembly 102 includes a piezoelectric actuator for each nozzle 104. Each piezoelectric actuator has an upper electrode and a lower electrode. The lower electrode of each piezoelectric actuator is electrically coupled to a common reference or ground signal line through a direct, low resistance electrical path. The direct, low resistance electrical path provides a robust electrical connection to the lower electrode and is compatible with a polished piezoelectric material surface.

To provide the direct, low resistance electrical path, a lower electrode material is deposited on the lower surface of a piezoelectric material layer having a beveled edge. The piezoelectric material layer is then attached to a substrate for printhead assembly 102 using an adhesive material. A first cut is made above the beveled edge of the piezoelectric material layer to expose a portion of the lower electrode material layer. An electrode material layer is then deposited over the piezoelectric material layer, the exposed portion of the lower electrode material layer, and the substrate. A second cut is then made to separate the electrode material layer into a first portion and a second portion. The first portion of the electrode material layer provides an upper electrode for a piezoelectric actuator. The second portion of the electrode material layer, which contacts the lower electrode material layer and the substrate, provides the direct, low resistance electrical path for the common reference or ground signal line.

In one example, printhead assembly 102 directs drops of ink toward a medium, such as print medium 116, to print onto print medium 116. Typically, nozzles 104 are arranged in one or more columns or arrays such that properly sequenced ejection of ink from nozzles 104 causes characters, symbols, and/or other graphics or images to be printed upon print medium 116 as printhead assembly 102 and print medium 116 are moved relative to each other.

Print medium 116 includes paper, card stock, envelopes, labels, transparent film, cardboard, rigid panels, or other suitable medium. In one example, print medium 116 is a continuous form or continuous web print medium 116, such as a continuous roll of unprinted paper.

Ink supply assembly 106 supplies ink to printhead assembly 102 and includes a reservoir 108 for storing ink. As such, ink flows from reservoir 108 to printhead assembly 102. In one example, ink supply assembly 106 and printhead assembly 102 form a recirculating ink delivery system. As such, ink flows back to reservoir 108 from printhead assembly 102. In one example, printhead assembly 102 and ink supply assembly 106 are housed together in an inkjet or fluidjet cartridge or pen. In another example, ink supply assembly 106 is separate from printhead assembly 102 and supplies ink to printhead assembly 102 through an interface connection, such as a supply tube.

Mounting assembly 110 positions printhead assembly 102 relative to media transport assembly 114, and media transport assembly 114 positions print medium 116 relative to printhead assembly 102. As such, a print zone 112 within which printhead assembly 102 deposits ink drops is defined adjacent to nozzles 104 in an area between printhead assembly 102 and print medium 116. Print medium 116 is advanced through print zone 112 during printing by media transport assembly 114.

In one example, printhead assembly 102 is a scanning type printhead assembly, and mounting assembly 110 moves printhead assembly 102 relative to media transport assembly 114 and print medium 116 during printing of a swath on print medium 116. In another example, printhead assembly 102 is a non-scanning type printhead assembly, and mounting assembly 110 fixes printhead assembly 102 at a prescribed position relative to media transport assembly 114 during printing of a swath on print medium 116 as media transport assembly 114 advances print medium 116 past the prescribed position.

Electronic controller 118 communicates with printhead assembly 102, mounting assembly 110, and media transport assembly 114. Electronic controller 118 receives data 120 from a host system, such as a computer, and includes memory for temporarily storing data 120. Typically, data 120 is sent to inkjet printing system 100 along an electronic, infrared, optical, or other suitable information transfer path. Data 120 represents, for example, a document and/or file to be printed. As such, data 120 forms a print job for inkjet printing system 100 and includes one or more print job commands and/or command parameters.

In one example, electronic controller 118 provides control of printhead assembly 102 including timing control for ejection of ink drops from nozzles 104. As such, electronic controller 118 defines a pattern of ejected ink drops that form characters, symbols, and/or other graphics or images on print medium 116. Timing control and, therefore, the pattern of ejected ink drops, is determined by the print job commands and/or command parameters. In one example, logic and drive circuitry forming a portion of electronic controller 118 is located on printhead assembly 102. In another example, logic and drive circuitry forming a portion of electronic controller 118 is located off printhead assembly 102.

Figure 2A:
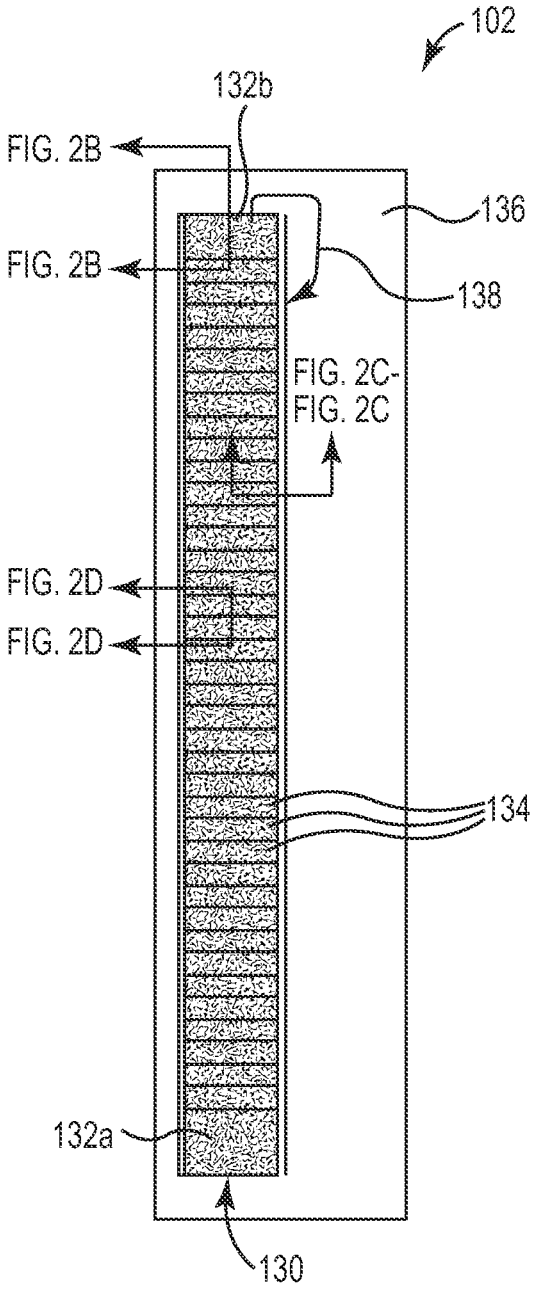
FIG. 2A illustrates a top view of one example of a printhead assembly.

FIG. 2A illustrates a top view of one example of printhead assembly 102. Printhead assembly 102 includes piezoelectric material 130, which has been mechanically separated into a plurality of individual piezoelectric actuators 134 and ground pads 132*a* and 132*b*. Ground pad 132*a* is formed at a first end of piezoelectric material 130, and ground pad 132*b* is formed at a second end of piezoelectric material 130 opposite the first end. Printhead assembly 102 includes an electrically conductive layer 136, which provides a direct ground connection, as indicated for example at 138, between ground pads 132*a* and 132*b* and a lower electrode of each piezoelectric actuator 134. In one example, electrically conductive layer 136 is a metal layer, such as Cr, NiV, Au, or other suitable electrically conductive material. Printhead assembly 102 also includes an upper electrode on each piezoelectric actuator 134.

Figure 2B:
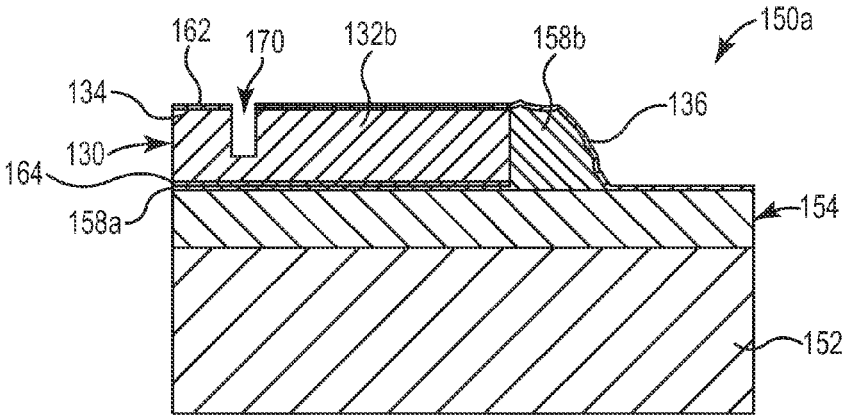
FIG. 2B illustrates a cross-sectional view of one example of a first portion of the printhead assembly illustrated in FIG. 2A.

FIG. 2B illustrates a cross-sectional view of one example of a first portion 150*a* of printhead assembly 102 illustrated in FIG. 2A. Portion 150*a* includes a substrate 152, a flexible membrane 154 on substrate 152, an adhesive layer 158*a*, 158*b*, a portion of a piezoelectric actuator 134, an upper electrode 162, a lower electrode 164, ground pad 132*b*, and a common reference or ground signal connection layer 136. Ground pad 132*b* is a least partially mechanically separated from adjacent piezoelectric actuator 134 by a cut 170. While FIG. 2B illustrates ground pad 132*b*, in one example the illustrated structure also applies to ground pad 132*a* at the opposite end of piezoelectric material 130.

An upper electrode 162 contacts the top surface of each piezoelectric actuator 134. A lower electrode 164 contacts the bottom surface of each piezoelectric actuator 134. A lower electrode 164 also contacts the bottom surface of each ground pad 132*a* and 132*b*. Each upper electrode 162 is electrically isolated from each lower electrode 164. Each upper electrode 162 and each lower electrode 164 includes an electrically conductive material, such as a metal or other suitable electrically conductive material. In one example, each upper electrode 162 includes Cr, NiV, Au, or other suitable material, and each lower electrode 164 includes Cr, Ni, or other suitable material.

An adhesive material layer 158*a*, 158*b* bonds each piezoelectric actuator 134 and ground pads 132*a* and 132*b* to flexible membrane 154. Adhesive material 158*a* provides a first region of the adhesive layer between lower electrodes 164 and flexible membrane 154. Adhesive material 158*b* provides a fillet of the adhesive material layer that extends from flexible membrane 154 up the sidewalls of ground pads 132*a* and 132*b*.

Common reference or ground signal connection layer 136 contacts the top surface of ground pads 132*a* and 132*b*, the top surface of adhesive fillet 136, and the top surface of flexible membrane 154. Common reference or ground signal connection layer 136 includes an electrically conductive material, such as a metal or other suitable electrically conductive material. In one example, common reference or ground signal connection layer 136 includes Cr, NiV, Au, or other suitable material. In one example, the portion of common reference or ground signal connection layer 136 on the top surface of ground pads 132*a* and 132*b* provides a contact pad for electrically coupling a ground line to electronic controller 118 (FIG. 1).

Figure 2C:
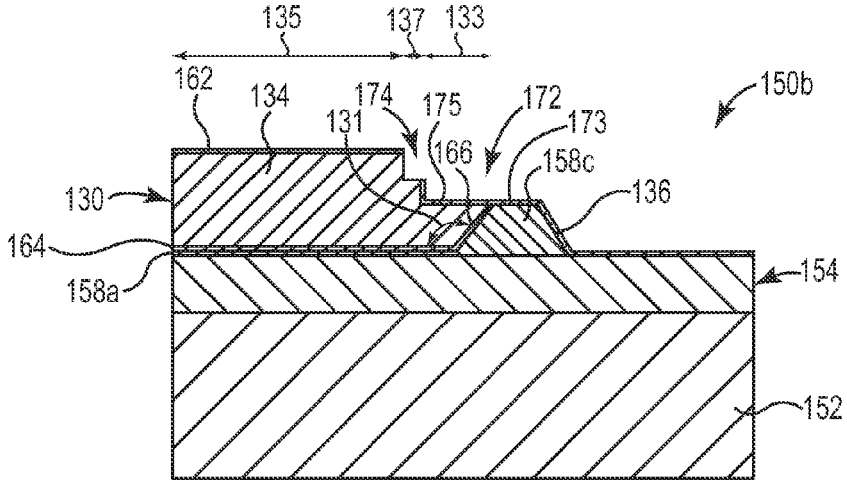
FIG. 2C illustrates a cross-sectional view of one example of a second portion of the printhead assembly illustrated in FIG. 2A.

FIG. 2C illustrates a cross-sectional view of one example of a second portion 150*b* of printhead assembly 102 illustrated in FIG. 2A. Portion 150*b* includes substrate 152, flexible membrane 154 on substrate 152, adhesive layer 158*a*, 158*c*, a portion of a piezoelectric actuator 134, upper electrode 162, lower electrode 164, and common reference or ground signal connection layer 136. While FIG. 2C illustrates one end of a piezoelectric actuator 134, in one example the illustrated structure also applies to the other end of piezoelectric actuator 134. In one example, portion 150*b* is arranged at an inlet end of a fluid chamber. In another example, portion 150*b* is arranged at an outlet end of a fluid chamber. In another example, portion 150*b* is arranged at both the inlet end and the outlet end of a fluid chamber.

Cut 172 defines an edge region 133 of each piezoelectric actuator 134. Due to cut 172, each edge region 133 of each piezoelectric actuator 134 has a thickness less than a thickness of a central region 135 of each piezoelectric actuator 134. Cut 172 defines surface 175 of piezoelectric actuator 134 and surface 173 of adhesive material 158*c*.

Cut 174 defines a transition region 137 between edge region 133 and central region 135 of each piezoelectric actuator 134. Cut 174 electrically isolates upper electrode 162 from common reference or ground signal connection layer 136. Due to cut 174, each transition region 137 of each piezoelectric actuator 134 has a thickness less than the thickness of central region 135 and greater than the thickness of edge region 133.

Upper electrode 162 contacts the top surface of central region 135 of each piezoelectric actuator 134. Lower electrode 164 contacts the bottom surface of each piezoelectric actuator 134 and the surface of a beveled portion 166 of piezoelectric actuator 134 at edge region 133 of piezoelectric actuator 134. The surface of piezoelectric actuator 134 at beveled portion 166 facing adhesive material 158*c* is at an angle as indicated at 131 greater than 90 degrees with respect to the bottom surface of piezoelectric actuator 134 facing flexible membrane 154.

Adhesive material layer 158*a*, 158*c* bonds each piezoelectric actuator 134 to flexible membrane 154. Adhesive material 158*a* provides a central region of the adhesive layer between lower electrode 164 and flexible membrane 154. Adhesive material 158*c* provides an edge region of the adhesive material layer, which extends up to surface 175 of piezoelectric actuator 134. Surface 175 of piezoelectric actuator 134 is substantially coplanar with surface 173 of adhesive material 158*c* and a surface of lower electrode 164 between piezoelectric actuator 134 and adhesive material 158*c*.

Common reference or ground signal connection layer 136 extends over surface 175 of piezoelectric actuator 134, surface 173 of adhesive material 158*c*, and the surface of flexible membrane 154. As such, connection layer 136 electrically contacts lower electrode 164 between edge region 133 of piezoelectric actuator 134 and adhesive material 158*c*. In one example, common reference or ground signal connection layer 136 also extends up the sidewall of transition region 137 of piezoelectric actuator 134.

Figure 2D:
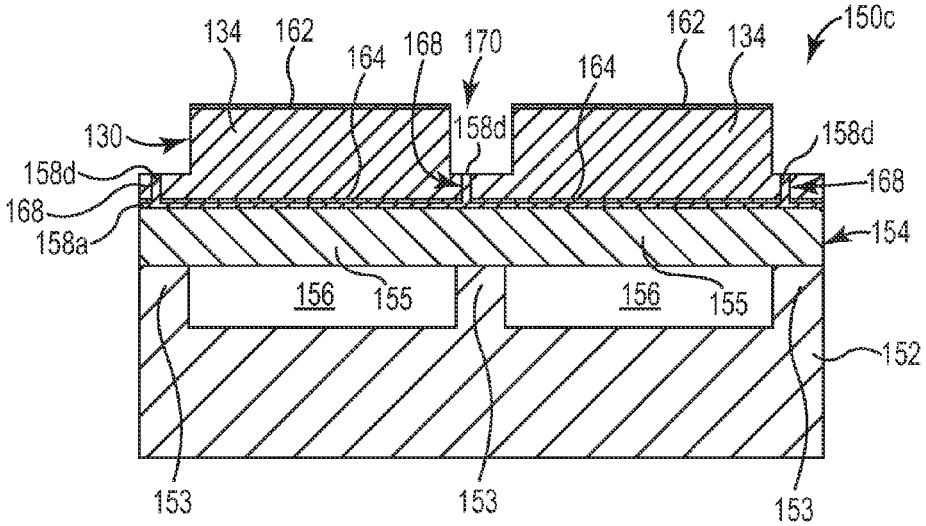
FIG. 2D illustrates a cross-sectional view of one example of a third portion of the printhead assembly illustrated in FIG. 2A.

FIG. 2D illustrates a cross-sectional view of one example of a third portion 150*c* of printhead assembly 102 illustrated in FIG. 2A. Portion 150*c* includes substrate 152, a flexible membrane 154, adhesive material layer 158*a*, 158*d*, piezoelectric actuators 134, upper electrodes 162, and lower electrodes 164. Piezoelectric actuators 134 are mechanically separated from each other by slits 168 and cuts 170.

An upper electrode 162 contacts the top surface of a central region of each piezoelectric actuator 134. A lower electrode 164 contacts the bottom surface of each piezoelectric actuator 134. Adhesive material layer 158*a*, 158*d* bonds each piezoelectric actuator 134 to flexible membrane 154. Adhesive material 158*a* provides a first region of the adhesive material layer between lower electrodes 164 and flexible membrane 154. Adhesive material 158*d* provides a second region of the adhesive material layer, which extends from first region 158*a* of the adhesive material layer, between adjacent piezoelectric actuators 134. In one example, adhesive material 158*d* fills slits 168 between adjacent piezoelectric actuators 134. In other examples, adhesive material 158*d* may not completely fill slits 168. Cuts 170 extending to slits 168 mechanically separate each piezoelectric actuator 134 from adjacent piezoelectric actuators 134.

Substrate 152, flexible membrane 154, and piezoelectric actuators 134 are arranged and interact, as described below, to eject drops of fluid from printhead assembly 102. In one example, substrate 152 has a plurality of fluid chambers 156 defined therein. Fluid chambers 156 are defined by sidewalls 153 of substrate 152. In one example, substrate 152 is a silicon substrate or another suitable substrate. Fluid chambers 156 are formed in substrate 152 using photolithography and etching techniques or other suitable fabrication techniques.

Fluid chambers 156 are connected to a supply of fluid. The fluid within each fluid chamber 156 is ejected from each fluid chamber 156 through an orifice or nozzle 104 (FIG. 1) in response to the activation of a corresponding piezoelectric actuator 134. In one example, fluid within fluid chambers 156 is ejected in a direction substantially perpendicular to a direction of displacement or deflection of flexible membrane 154 (e.g., in a direction into or out of the plane of FIG. 2D).

Flexible membrane 154 is supported by substrate 152 and extends over fluid chambers 156. In one example, flexible membrane 154 is supported by sidewalls 153 of substrate 152. Flexible membrane 154 is a single membrane extended over a plurality of fluid chambers 156. As such, in one example, flexible membrane 154 includes flexible membrane portions 155 each defined over one fluid chamber 156. Flexible membrane 154 is formed of a flexible material such as glass, a flexible thin film of silicon nitride or silicon carbide, a flexible thin layer of silicon, or other suitable flexible material. In one example, flexible membrane 154 is attached to substrate 154 by anodic bonding or other suitable technique.

Piezoelectric actuators 134 are provided on flexible membrane 154. More specifically, each piezoelectric actuator 134 is arranged on a respective flexible membrane portion 155. Piezoelectric actuators 134 deflect flexible membrane portions 155 such that when flexible membrane portions 155 of flexible membrane 154 deflect, droplets of fluid are ejected from a respective orifice or nozzle 104 (FIG. 1) of printhead assembly 102.

In one example, piezoelectric actuators 134 are provided or formed on a side of flexible membrane 154 opposite fluid chambers 156. As such, piezoelectric actuators 134 are not in direct contact with fluid contained within fluid chambers 156. Thus, potential affects of fluid contacting piezoelectric actuators 134, such as corrosion or electrical shorting, are reduced.

Each piezoelectric actuator 134 include a piezoelectric material which changes shape, for example, expands and/or contracts, in response to an electrical signal applied between upper electrode 162 and lower electrode 164. Thus, in response to the electrical signal, piezoelectric actuators 134 apply a force to respective flexible membrane portions 155 that cause flexible membrane portions 155 to deflect. The piezoelectric material may include lead zirconium titanate (PZT), zinc oxide, a piezoceramic material such as barium titanate, lead lanthanum zirconium titanate (PLZT), or other suitable piezoelectric material.

Piezoelectric actuators 134 are formed from a single or common bulk piezoelectric material. More specifically, the single or common bulk piezoelectric material is provided on flexible membrane 154, and selective portions of the piezoelectric material are removed via cuts 170 such that the remaining portions of the piezoelectric material define piezoelectric actuators 134.

Figure 3:
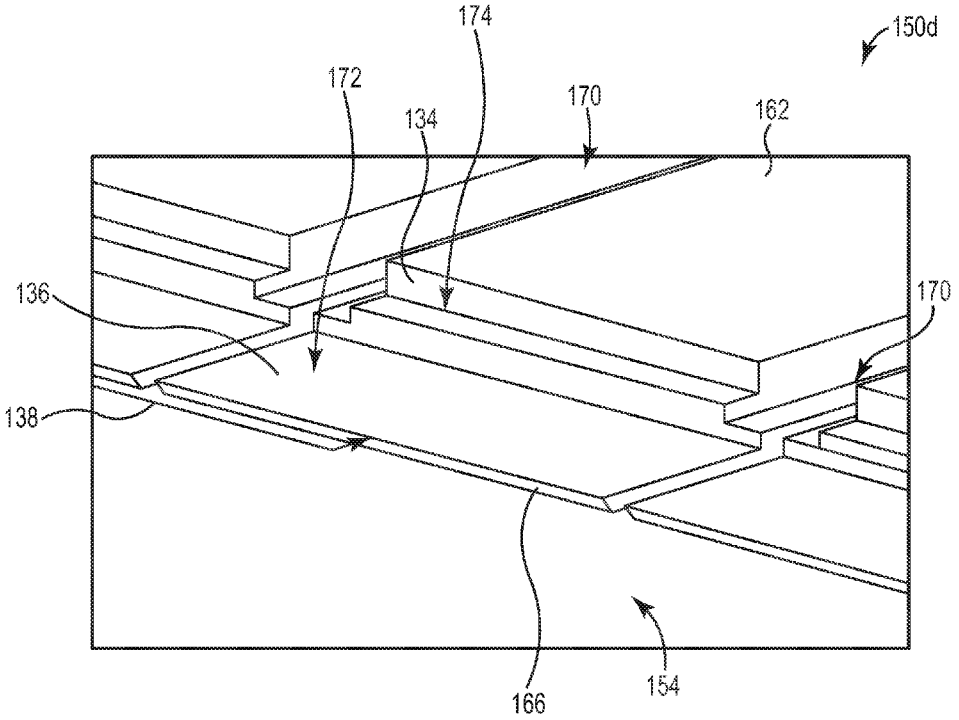
FIG. 3 illustrates a perspective view of one example of a portion of the printhead assembly.

FIG. 3 illustrates a perspective view of one example of a portion 150*d* of printhead assembly 102 with the adhesive material layer removed for clarity. Portion 150*d* includes flexible membrane 154, a portion of a piezoelectric actuator 134, upper electrode 162, and common reference or ground signal connection layer 136. Portion 150*d* also includes cuts 170, 172, and 174 previously described and illustrated with reference to FIGS. 2B-2D. The direct ground connection (as previously illustrated in FIG. 2A) is indicated for example at 138.

The following FIGS. 4-11 illustrate examples for fabricating a fluid ejection device, such as printhead assembly 102 including portion 150*b* as previously described and illustrated with reference to FIG. 2C. While the following FIGS. 4-11 illustrate the fabrication of one piezoelectric actuator 134 as illustrated in FIG. 2C, the described process is applicable to the fabrication of any suitable number of piezoelectric actuators 134 for printhead assembly 102.

Figure 4:
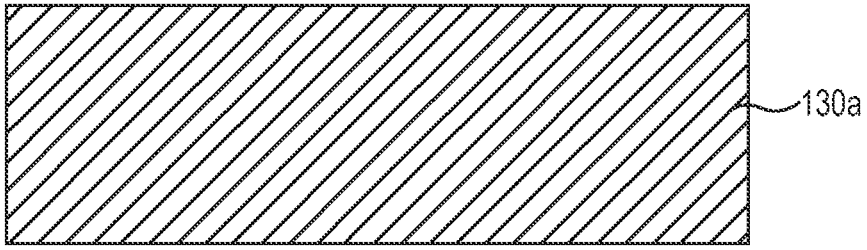
FIG. 4 illustrates a cross-sectional view of one example of a piezoelectric material layer.

FIG. 4 illustrates a cross-sectional view of one example of a piezoelectric material layer 130*a*. In one example, piezoelectric material layer 130*a* is a layer of PZT, zinc oxide, a piezoceramic material such as barium titanate, PLZT, or other suitable piezoelectric material. In one example, piezoelectric material layer 130*a* has a thickness between 180 μm and 400 μm. In one example, the bottom surface of piezoelectric material layer 130*a* is polished to reduce the roughness of the bottom surface to an Ra between 20 nm and 800 nm.

Figure 5:
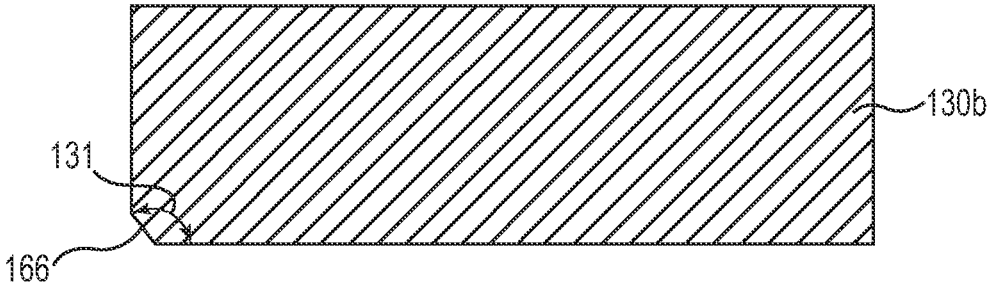
FIG. 5 illustrates a cross-sectional view of one example of the piezoelectric material layer with a beveled edge.

FIG. 5 illustrates a cross-sectional view of one example of piezoelectric material layer 130*b* with a beveled edge 166. Piezoelectric material layer 130*a* is machined with a beveled shaped saw blade or other suitable tool to provide piezoelectric material layer 130*b* having beveled edge 166. The angle 131 between the surface of piezoelectric material layer 130*b* at beveled edge 166 and the bottom surface of piezoelectric material layer 130*b* is greater than 90 degrees. In one example, angle 131 is between 120 degrees and 150 degrees.

Figure 6:
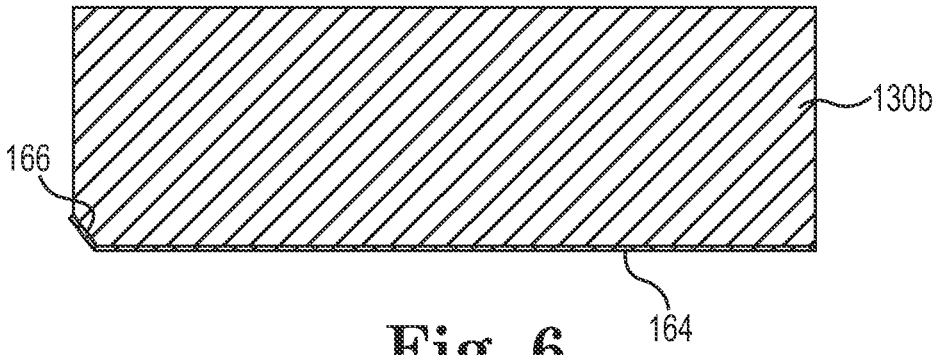
FIG. 6 illustrates a cross-sectional view of one example of a lower electrode material layer deposited on the piezoelectric material layer.

FIG. 6 illustrates a cross-sectional view of one example of a lower electrode material layer 164 deposited on piezoelectric material layer 130*b*. An electrically conductive material, such as a metal (e.g., Cr or Ni) or other suitable electrically conductive material is deposited onto the bottom surface and beveled surface 166 of piezoelectric material layer 130*b* to provide lower electrode material layer 164. Lower electrode material layer 164 is deposited onto piezoelectric material layer 130*b* using sputtering or other suitable deposition technique. In one example, lower electrode material layer 164 has a thickness between 0.3 μm and 1.5 μm.

Figure 7:
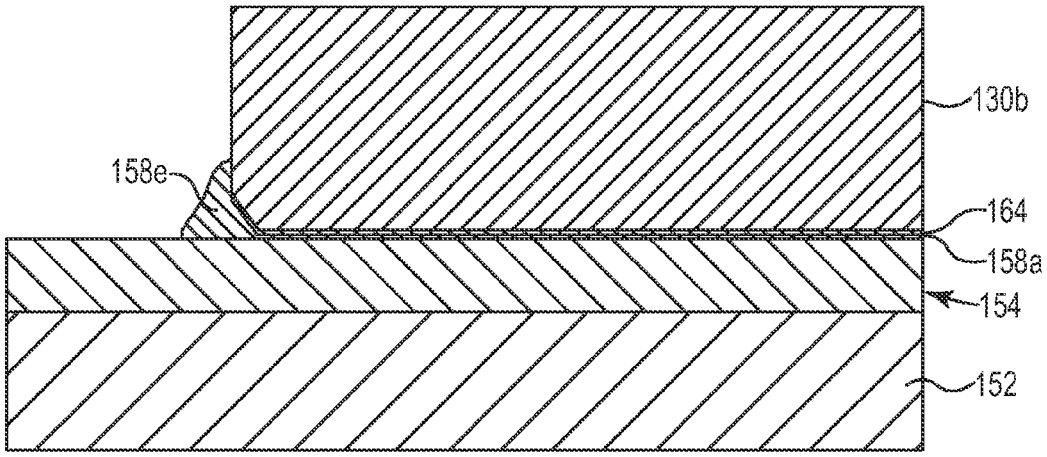
FIG. 7 illustrates a cross-sectional view of one example of the piezoelectric material layer attached to a flexible membrane via an adhesive material layer.

FIG. 7 illustrates a cross-sectional view of one example of piezoelectric material layer 130*b* attached to flexible membrane 154 via an adhesive layer 158*a*, 158*e*. Lower electrode material layer 164 and/or flexible membrane 154 is coated with an adhesive material such as epoxy or other suitable adhesive material. Piezoelectric material layer 130*b* is then aligned with flexible membrane 154 and pressed onto flexible membrane 154 to attach piezoelectric material layer 130*b* to flexible membrane 154. The pressing of piezoelectric material layer 130*b* onto flexible membrane 154 forms a fillet of adhesive material 158*e* extending up the sidewall of piezoelectric material layer 130*b*. The pressing of piezoelectric material layer 130*b* onto flexible membrane 154 also forms fillet of adhesive material 158*b* previously described and illustrated with reference to FIG. 2B. Adhesive layer 158*a*, 158*b*, 158*e* is then cured. In one example, the thickness of adhesive layer 158*a* between lower electrode material layer 164 and flexible membrane 154 is between 0.5 μm and 1.5 μm.

Figure 8:
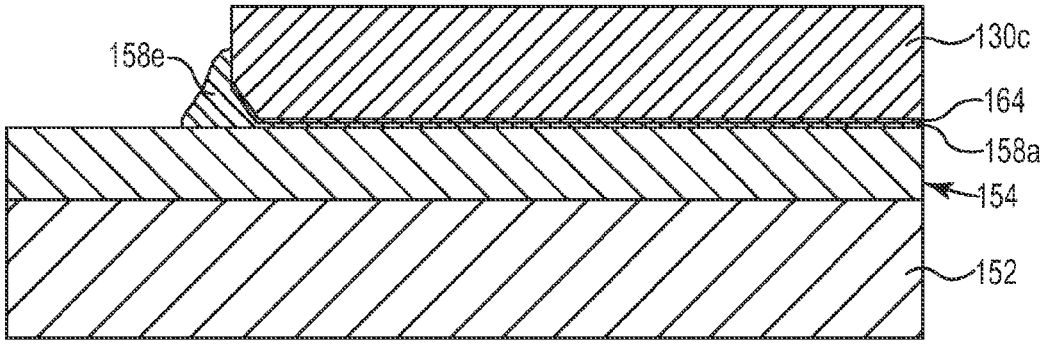
FIG. 8 illustrates a cross-sectional view of one example of the piezoelectric material layer after back-grinding.

FIG. 8 illustrates a cross-sectional view of one example of piezoelectric material layer 130*c* after back-grinding. Piezoelectric material layer 130*b* is subjected to back-grinding to reduce the thickness of the piezoelectric material layer to between 30 μm and 70 μm to provide piezoelectric material layer 130*c*.

Figure 9:
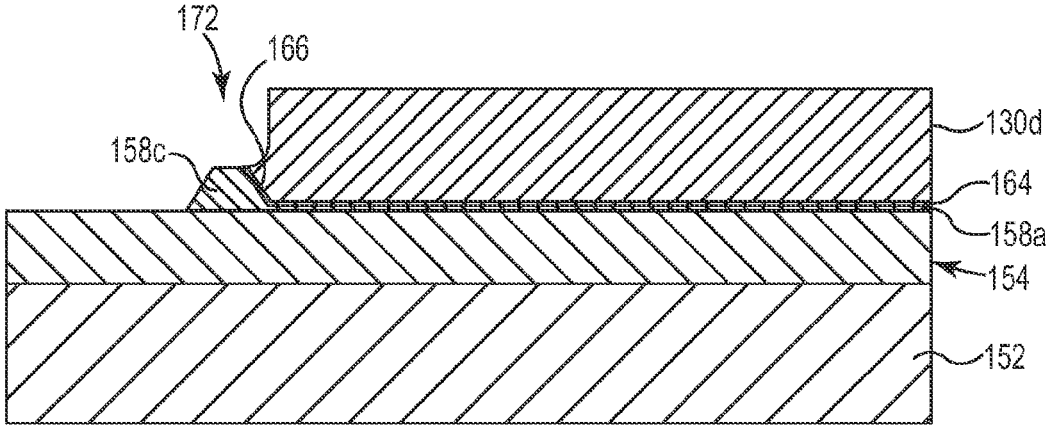
FIG. 9 illustrates a cross-sectional view of one example of the piezoelectric material layer after trimming an edge region of the piezoelectric material layer and an edge region of the adhesive material layer.

FIG. 9 illustrates a cross-sectional view of one example of piezoelectric material layer 130*d* after trimming an edge region of piezoelectric material layer 130*c* and adhesive material 158*e* of the adhesive layer. An edge region of piezoelectric material layer 130*c* and adhesive material 158*e* of the adhesive material layer are cut with a saw or other suitable tool at 172 to expose a portion of lower electrode material layer 164 and to provide a second region 158*c* of adhesive material and piezoelectric material layer 130*d*. In one example, the bottom of cut 172 is between 5 μm and 20 μm above the top surface of flexible membrane 154.

Figure 10:
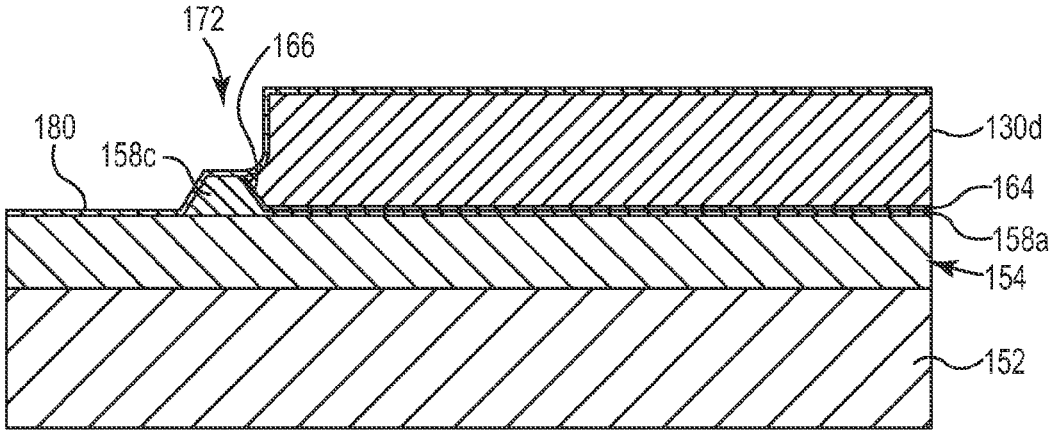
FIG. 10 illustrates a cross-sectional view of one example of an electrode material layer deposited on the piezoelectric material layer, the adhesive material layer, and the flexible membrane.

FIG. 10 illustrates a cross-sectional view of one example of an electrode material layer 180 deposited on the exposed surfaces of piezoelectric material layer 130*d*, lower electrode material layer 164, adhesive material 158*c*, and flexible membrane 154. An electrically conductive material, such as a metal (e.g., Cr, NiV, or Au), or other suitable electrically conductive material is deposited onto the exposed surfaces of piezoelectric material layer 130*d*, lower electrode material layer 164, adhesive material 158*c*, and flexible membrane 154 to provide electrode material layer 180. Electrode material layer 180 is deposited onto piezoelectric material layer 130*d*, lower electrode material layer 162, adhesive material 158*c*, and flexible membrane 154 using sputtering or other suitable deposition technique. In one example, electrode material layer 180 has a thickness between 0.3 μm and 1.5 μm.

Figure 11:
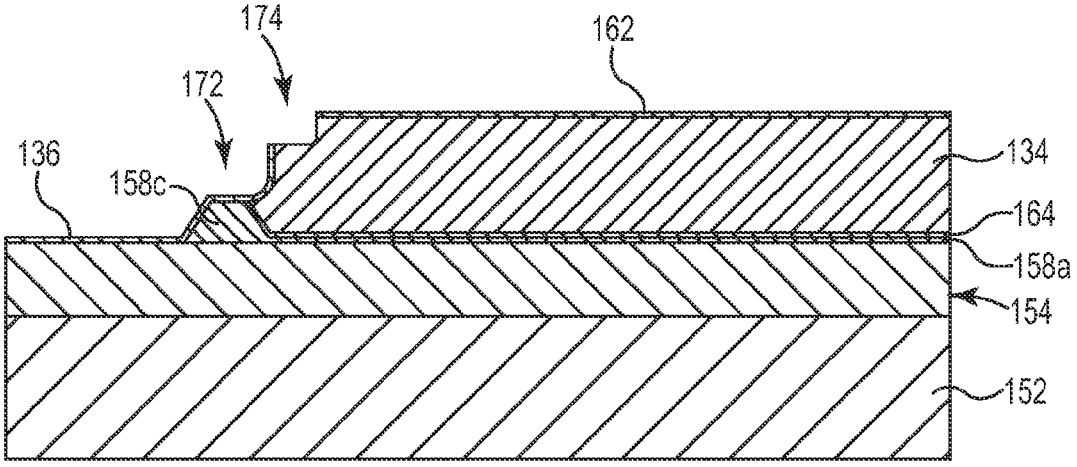
FIG. 11 illustrates a cross-sectional view of one example of the piezoelectric material layer after trimming a transition region of the piezoelectric material layer to electrically isolate an upper electrode material layer from a common reference or ground signal connection layer.

FIG. 11 illustrates a cross-sectional view of one example of a piezoelectric actuator 134 after trimming a transition region of piezoelectric material layer 130*d* to electrically separate electrode material layer 180 into an upper electrode layer 162 and a common reference or ground signal connection layer 136. Piezoelectric material layer 130*d* is cut with a saw or other suitable tool at 174 to electrically separate electrode material layer 180 into an upper electrode layer 162 and a common reference or ground signal connection layer 136. In one example, the bottom of cut 174 is between 20 μm and 50 μm above the top surface of flexible membrane 154. Piezoelectric material layer 130*d* is also cut to provide separate piezoelectric actuators 134 and upper electrodes 162 as previously described and illustrated with reference to FIG. 2D.

Figure 12:
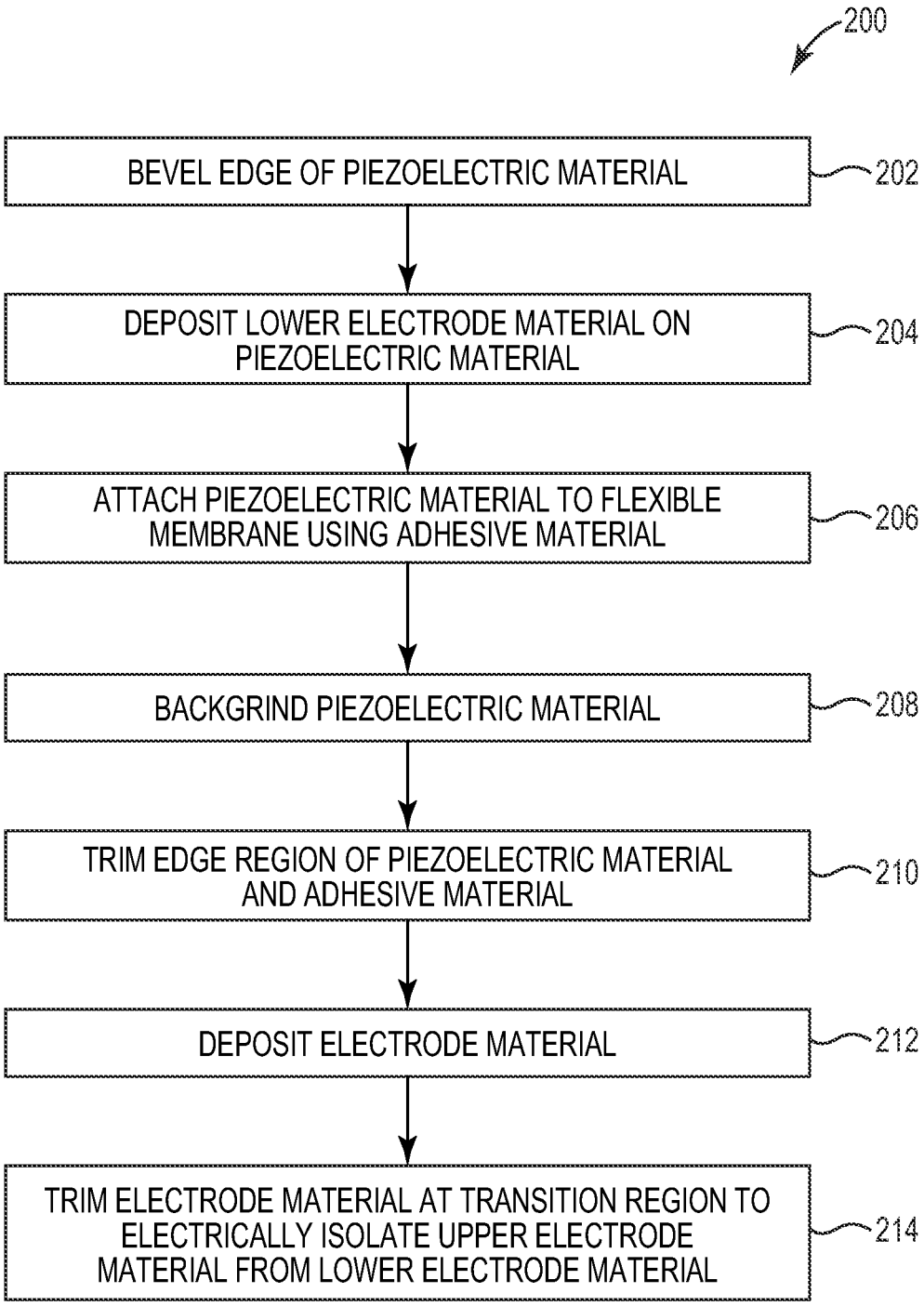
FIG. 12 is a flow diagram illustrating one example of a method for fabricating a printhead assembly.

FIG. 12 is a flow diagram illustrating one example of a method 200 for fabricating a printhead assembly, such as printhead assembly 102 previously described and illustrated with reference to FIGS. 1-3. At 202, an edge of bulk piezoelectric material is beveled (e.g., FIGS. 4 and 5). At 204, a lower electrode material is deposited on the bulk piezoelectric material (e.g., FIG. 6). At 206, the piezoelectric material is attached to a flexible membrane using an adhesive material (e.g., FIG. 7). At 208, the piezoelectric material is subjected to back-grinding (e.g., FIG. 8). At 210, an edge region of the piezoelectric material and the adhesive material is trimmed to expose a portion of the lower electrode material at the beveled edge of the piezoelectric material. (e.g., FIG. 9). At 212, an electrode material is deposited onto exposed portions of the piezoelectric material, the adhesive material, the lower electrode material, and the flexible membrane (e.g., FIG. 10). At 214, the electrode material at a transition region of the piezoelectric material is trimmed to electrically isolate the upper electrode material from the lower electrode material (e.g., FIG. 11).

Examples provide a fluid ejection device including piezoelectric actuators having a robust, direct, low resistance ground connection. The direct ground connection allows polished piezoelectric actuators to be used and increases the reliability of the ground connection.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fluid ejection device comprising:

a flexible membrane;

an adhesive layer on the flexible membrane, the adhesive layer comprising an edge region and a central region;

a piezoelectric material layer comprising an edge region and a central region, a surface of the edge region of the piezoelectric material layer coplanar with a top surface of the edge region of the adhesive layer;

a first electrically conductive layer between the piezoelectric material layer and the adhesive layer such that a surface of the first electrically conductive layer is coplanar with the surface of the edge region of the piezoelectric material layer and the top surface of the edge region of the adhesive layer; and a second electrically conductive layer over the surface of the edge region of the piezoelectric material layer, the top surface of the edge region of the adhesive layer, the surface of the first electrically conductive layer, and the flexible membrane, wherein the top surface of the edge region of the adhesive layer and the surface of the edge region of the piezoelectric material layer are substantially parallel to the flexible membrane.

2. The fluid ejection device of claim 1, further comprising:

a third electrically conductive layer on the central region of the piezoelectric material layer, the third electrically conductive layer electrically isolated from the second electrically conductive layer.

3. The fluid ejection device of claim 1, wherein the central region of the piezoelectric material layer is thicker than the edge region of the piezoelectric material layer in a direction substantially perpendicular to the flexible membrane.

4. The fluid ejection device of claim 3, wherein the piezoelectric material layer comprises a transition region between the edge region and the central region of the piezoelectric material layer, the transition region thinner than the central region of the piezoelectric material layer and thicker than the edge region of the piezoelectric material layer in the direction substantially perpendicular to the flexible membrane.

5. The fluid ejection device of claim 1, wherein a surface of the piezoelectric material layer facing the edge region of the adhesive layer is at an angle greater than 90 degrees with respect to a surface of the piezoelectric material layer facing the flexible membrane.

6. The fluid ejection device of claim 1, wherein the second electrically conductive layer electrically couples the first electrically conductive layer to a ground pad.

7. The fluid ejection device of claim 1, wherein the piezoelectric material layer comprises a PZT layer.

8. A fluid ejection device comprising:

a flexible membrane supported by a substrate and over a fluid chamber;

an adhesive layer on the flexible membrane, the adhesive layer comprising an edge region and a central region;

a piezoelectric material layer comprising an edge region and a central region, the edge region having a beveled edge, a top surface of the edge region of the piezoelectric material layer coplanar with a top surface of the edge region of the adhesive layer;

a first metal layer between the piezoelectric material layer and the adhesive layer such that a surface of the first metal layer is coplanar with the top surface of the edge region of the piezoelectric material layer and the top surface of the edge region of the adhesive layer; and a second metal layer over the top surface of the edge region of the piezoelectric material layer, the top surface of the edge region of the adhesive layer, the surface of the first metal layer, and the flexible membrane to electrically couple the first metal layer to a ground pad, wherein the top surface of the edge region of the adhesive layer and the top surface of the edge region of the piezoelectric material layer are substantially parallel to the flexible membrane.

9. The fluid ejection device of claim 8, further comprising:

a third metal layer on the central region of the piezoelectric material layer, the third metal layer electrically isolated from the second metal layer.

10. The fluid ejection device of claim 9, wherein the first metal layer provides a first electrode and the third metal layer provides a second electrode, the first and second electrodes configured to deform the piezoelectric material layer in response to an applied voltage to deflect the flexible membrane.

11. The fluid ejection device of claim 8, wherein the flexible membrane comprises glass, wherein the first metal layer comprises Cr or Ni, wherein the second metal layer comprises Cr, NiV, or Au, wherein the piezoelectric material layer comprises a PZT layer, and wherein the adhesive layer comprises an epoxy.

12. A method for fabricating a fluid ejection device, the method comprising:

providing a piezoelectric material layer;

beveling an edge of the piezoelectric material layer;

depositing a first electrically conductive layer over the piezoelectric material layer including over the beveled edge of the piezoelectric material layer;

providing a flexible membrane;

attaching the piezoelectric material layer to the flexible membrane via an adhesive layer such that the first electrically conductive layer faces the flexible membrane;

trimming an edge region of the piezoelectric material layer and an edge region of the adhesive layer such that the beveled edge of the piezoelectric material layer is maintained and to expose the first electrically conductive layer at the beveled edge of the piezoelectric material layer between the edge region of the piezoelectric material layer and the edge region of the adhesive layer;

depositing a second electrically conductive layer over the piezoelectric material layer, the first electrically conductive layer, the edge region of the adhesive layer, and the flexible membrane to electrically couple the first electrically conductive layer to a ground pad; and trimming the second electrically conductive layer to electrically isolate the second electrically conductive layer over a central region of the piezoelectric material layer from the second electrically conductive layer over the edge region of the piezoelectric material layer.

13. The method of claim 12, further comprising:

back-grinding the piezoelectric material layer after attaching the piezoelectric material layer and prior to trimming the edge region of the piezoelectric material layer and the edge region of the adhesive layer.

14. The method of claim 12, wherein depositing the first electrically conductive layer comprises sputtering one of Cr and Ni over the piezoelectric material layer including over the beveled edge of the piezoelectric material layer, and wherein depositing the second electrically conductive layer comprises sputtering one of Cr, NiV, and Au over the piezoelectric material layer, the first electrically conductive layer, the edge region of the adhesive layer, and the flexible membrane.

15. The method of claim 12, further comprising:

polishing the piezoelectric material layer to have an Ra between 20 nm and 800 nm prior to depositing the first electrically conductive layer.

16. The fluid ejection device of claim 1, wherein the second electrically conductive layer directly contacts the surface of the edge region of the piezoelectric material layer, directly contacts the top surface of the edge region of the adhesive layer, directly contacts the surface of the first electrically conductive layer, and directly contacts the flexible membrane.

17. The fluid ejection device of claim 8, wherein the second metal layer directly contacts the top surface of the edge region of the piezoelectric material layer, directly contacts the top surface of the edge region of the adhesive layer, directly contacts the surface of the first metal layer, and directly contacts the flexible membrane.

* * * * *

UNITED STATES PATENT AND TRADEMARK OFFICE

CERTIFICATE OF CORRECTION

PATENT NO. : 8,939,556 B2
APPLICATION NO. : 13/834524
DATED : January 27, 2015
INVENTOR(S) : Jeffrey R. Pollard et al.

It is certified that error appears in the above-identified patent and that said Letters Patent is hereby corrected as shown below:

Title page item (71), Applicant, in column 1, line 1, delete "Developement" and insert -- Development --, therefor.

Signed and Sealed this
Twenty-sixth Day of May, 2015

Michelle K. Lee

Michelle K. Lee
*Director of the United States Patent and Trademark Office*